United States Patent [19]

Walker

[11] 4,434,757

[45] Mar. 6, 1984

[54] ROTARY PISTON INTERNAL COMBUSTION ENGINE

[76] Inventor: Hamilton Walker, 46 Whytehead Crescent, Kohimarama, Auckland, New Zealand

[21] Appl. No.: 185,408

[22] Filed: Sep. 9, 1980

[30] Foreign Application Priority Data

Sep. 12, 1979 [NZ] New Zealand ..... 191548

[51] Int. Cl.[3] ..... F02B 53/00

[52] U.S. Cl. ..... 123/241; 418/270

[58] Field of Search ..... 123/241; 418/270, 188

[56] References Cited

U.S. PATENT DOCUMENTS

| | | | |
|---|---|---|---|
| 1,102,746 | 7/1914 | Hauer | 418/188 |
| 3,036,560 | 5/1962 | Geiger | 418/270 |
| 3,295,505 | 1/1967 | Jordan | 123/241 |
| 3,442,257 | 5/1969 | Walker | 123/241 |

FOREIGN PATENT DOCUMENTS

| | | |
|---|---|---|
| 961562 | 6/1964 | United Kingdom . |
| 1070592 | 6/1967 | United Kingdom . |
| 1147047 | 4/1969 | United Kingdom . |
| 1242333 | 8/1971 | United Kingdom . |
| 1289479 | 9/1972 | United Kingdom . |
| 1476501 | 6/1977 | United Kingdom . |
| 1554788 | 10/1979 | United Kingdom . |

*Primary Examiner*—Michael Koczo

*Attorney, Agent, or Firm*—Young & Thompson

[57] ABSTRACT

A rotary internal combustion engine comprises a stator having an enclosed chamber defined by a pair of opposing side walls and a peripheral wall extending therebetween. A rotor in the chamber is rotatable by a shaft extending between the side walls. The rotor has at least one arm projecting radially from the shaft and a rotator member pivotally mounted on the end of the arm by a pivot pin. The rotator member has a working surface which spans between the side walls and has leading and trailing surfaces in contact with the peripheral wall, thereby defining a combustion chamber. Air is introduced into the chamber by at least one outlet passage which is rotatable within the chamber and opens radially, with respect to the shaft, into the chamber.

20 Claims, 10 Drawing Figures

ROTARY PISTON INTERNAL COMBUSTION ENGINE

This invention relates to rotary internal combustion engines or the like and has for its main object to provide an improved rotary internal combustion engine through the knowledge gained when making prototypes of the U.S. Pat. No. 3,442,257 and having a novel construction and/or arrangement of its parts resulting in a more efficient engine than those covered in the basic patent.

Broadly in one aspect the invention consists of a rotary internal combustion engine comprising a stator having an enclosed chamber, said chamber being defined by a pair of opposing side walls and a peripheral wall extending therebetween, a rotor disposed within the chamber and mounted for rotation by a shaft extending between said side walls, said rotor including at least one arm projecting radially from said shaft and a rotator member pivotally mounted on the end of said arm by a pivot pin, said rotator member having a working surface which spans between said side walls and has leading and trailing surfaces in contact with said peripheral wall thereby defining a combustion chamber, and means for introducing air into said chamber said means including at least one outlet passage which is rotatable within said chamber and opens radially, with respect to said shaft, into said chamber.

In more fully describing the invention according to its preferred embodiments reference will be made to the accompanying drawings in which.

FIG. 10 is an elevation view of a further modified form of the rotator.

Figure 1:
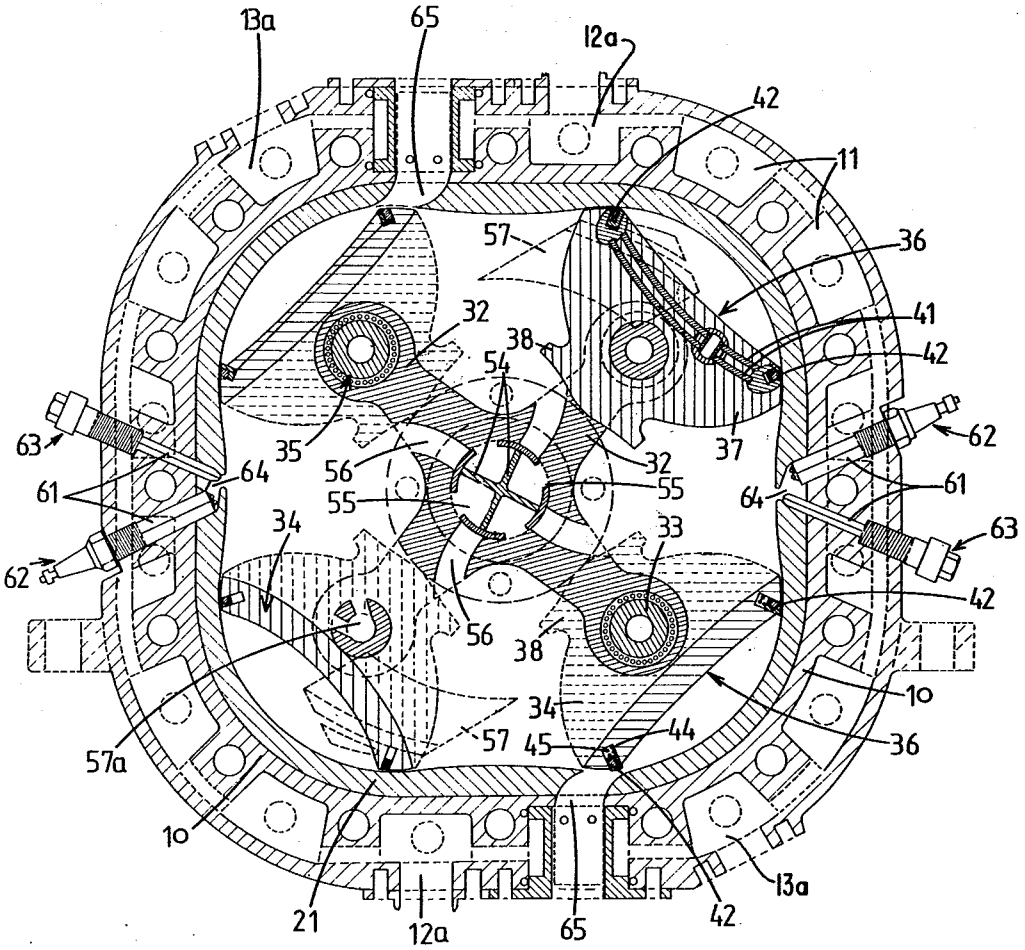
FIG. 1 is sectioned elevation view of one form of the invention.
Figure 2:
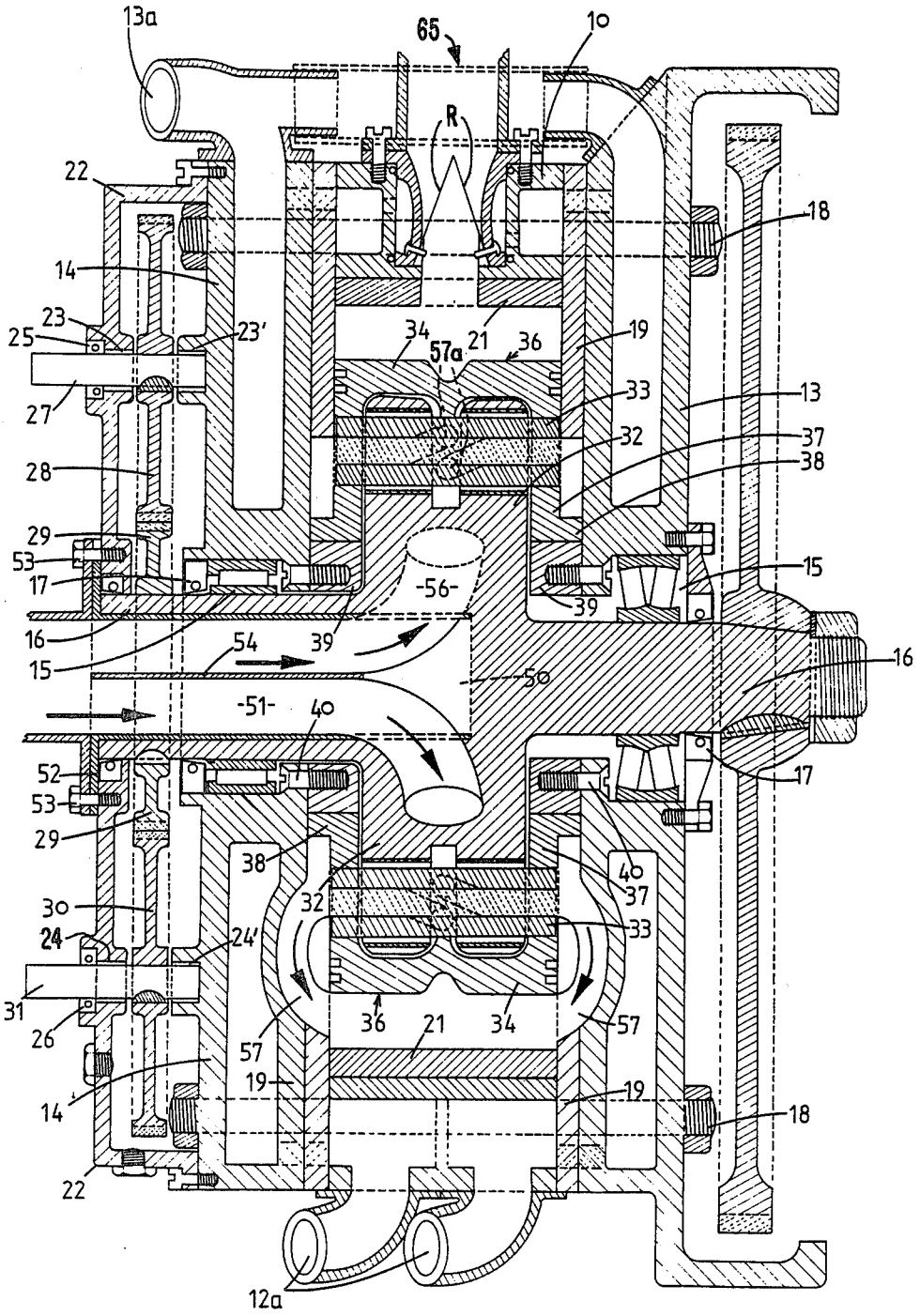
FIG. 2 is a section side view of the engine shown in FIG. 1.

FIGS. 1 and 2 of the drawings illustrate a diesel rotary engine which has eight power cycles per revolution. By virtue of its design and mode of operation the engine is automatically supercharged.

The stator is formed by a cast housing 10 having cooling passages 11 through which water flows from a dual input 12*a* to an output 13*a*. As can be seen in FIG. 1 a cooling system exists for each half of the engine. Casing 10 is covered on both sides by face plates 13 and 14 which have central openings to receive bearings 15 in which the main shaft 16 is journalled. Seals 17 are provided at the outer faces of bearings 15. The face plates 13 and 14 and casing 10 are held together by studs or bolts 18 and disposed between casing 10 and face plates 13 and 14 are stainless steel liner 19. The internal opening or chamber in casing 10 is of substantially square shape with the corners rounded as can be clearly seen in FIG. 1. The inner surface of casing 10 is covered by a spheroidal graphite nodular-iron liner 21.

Face plate 14 has a cover plate 22 mounted thereon and this has a pair of openings which mount bearings 23 and 24 with associated seals 25 and 26. Journalled by bearing 23 and an associated bearing 23' in face plate 14 is a drive shaft 27 for a fan and water pump (not shown). Drive shaft 27 is driven by a gear 28 which engages with gear 29 on shaft 16. In a like manner gear 29 engages with gear 30 mounted on shaft 31. The fuel injection drive is provided by shaft 31 which as shown projects from cover plate 22. Shaft 31 is as shown journalled by bearing 24 and bearing 24' of cover plate 14.

Shaft 16 has four pairs of diametrically opposed arms 32 each of which has a opening located in each of projecting fingers formed by the free end of the arm being bifurcated. A gudgeon pin 33 passes through the aligned openings in each arm 32 and locates thereon a rotator 34. A needle roller bearing 35 locates gudgeon 33 in each opening. Each rotator is shaped as shown in FIG. 1 and has a working face 36. A pair of spaced apart parallel flanges 37 extend from working surface 36 and these pass either side of arm 32. Flanges 37 have openings through which gudgeons 33 pass. Each of flanges 37 has a control arm 38 formed at the free end thereof and these arms are more clearly shown in FIG. 2. Control arms 38 engage with a control cam 39 which is fastened by mechanical fastenings 40 to the inner surfaces of face plates 13 and 14.

Each side face 37 of the rotator 34 has a pair of seals 41 located in grooves. A seal bar 42 located in a groove 44 extends across the leading and trailing edges of the rotator working face 36. The outer face of each seal bar 42 is profiled for low friction engagement with the liner 21 and this engagement is maintained by springs 45. Each of seal bars 42 is preceded by an internal control pad, as will be described hereinafter, which is located in working face 36 immediately preceding seal bar 42.

The end of shaft 16 which projects through face plate 14 has a central bore 50. A tubular insert 51 is positioned within bore 50 and is flanged at its outer end at 52 to be bolted by fastenings 53 to cover 22. Insert 51 has a pair of diametrically disposed partitions 54 which are at right angles to one another. Adjacent the inner end of insert 51 openings 55 are provided in the wall of the insert. It will be appreciated that insert 51 remains stationary due to its fastening to cover 22. Air passages 56 are provided in each of arms 32 and as can be seen more clearly in FIG. 1 are alignable with openings 55. Air passages 56 thus extend between bore 50 and an opening in the arm which opens into casing 10.

Two air intake tunnels 57 are formed in each of face plates 13 and 14. Air intake is thus achieved by air flowing through insert 51 to pass through passages 56 when said passages are aligned with openings 55. This air flow can pass through intake tunnel 57 as shown by the arrows in FIG. 2 to enter into the combustion chamber formed by working face 36 and liners 19 and 21.

Casing 10 has a pair of tapped openings 61 situated at either side thereof as can be seen in FIG. 1. In one tapped opening a glow plug 62 is inserted so that the electrode end locates within a recess 64 in liner 21. The second tapped bore 61 has a fuel injector 63 inserted therein and the outlet end of the injector 63 locates in cavity 64. Cavity 64 is located in an area where liner 21 is slightly bowed in toward shaft 16 but this can be straight in lower torque models of the engine. Accordingly, as shaft 16 rotates air is drawn and compressed through intake tunnel 57 and then compressed within the aforementioned combustion chamber so that compression thereof is complete at the time of fuel injection. The resultant mixture fires to complete the power stroke, when the exhaust gases pass out of the exhaust port shown at 65. The exhaust chamber has a pair of control reed valves R (see FIG. 2) these restrict the air inside the casing 21 giving a light supercharging.

It will thus be appreciated that there are eight power cycles per revolution and with the engine illustrated in the drawings the combustion pressure is up to 1500 lbs per square inch. The explosions are balanced at 180° equalizing the pressure on the shaft so there is practically no load on its bearings and a double torque engine is provided. In the illustrated example the fuel capacity is 1760 c.c. per revolution. The glow plugs 62 are provided merely for starting.

Whilst the engine is water cooled, centrifugal air cooling is provided internally between heads for the whole 360° of each revolution. It will be appreciated that air flows through insert 51 to issue through passages 56 when these passages become successively aligned with the four openings 55. Accordingly, air enters into the casing to provide internal air cooling the air then being induced through intake tunnel 57 to the combustion areas. The incoming air is also bled through passages 57*a* in the centre of gudgeons 33 to internally cool the gudgeons and needle roller bearings.

Figure 3:
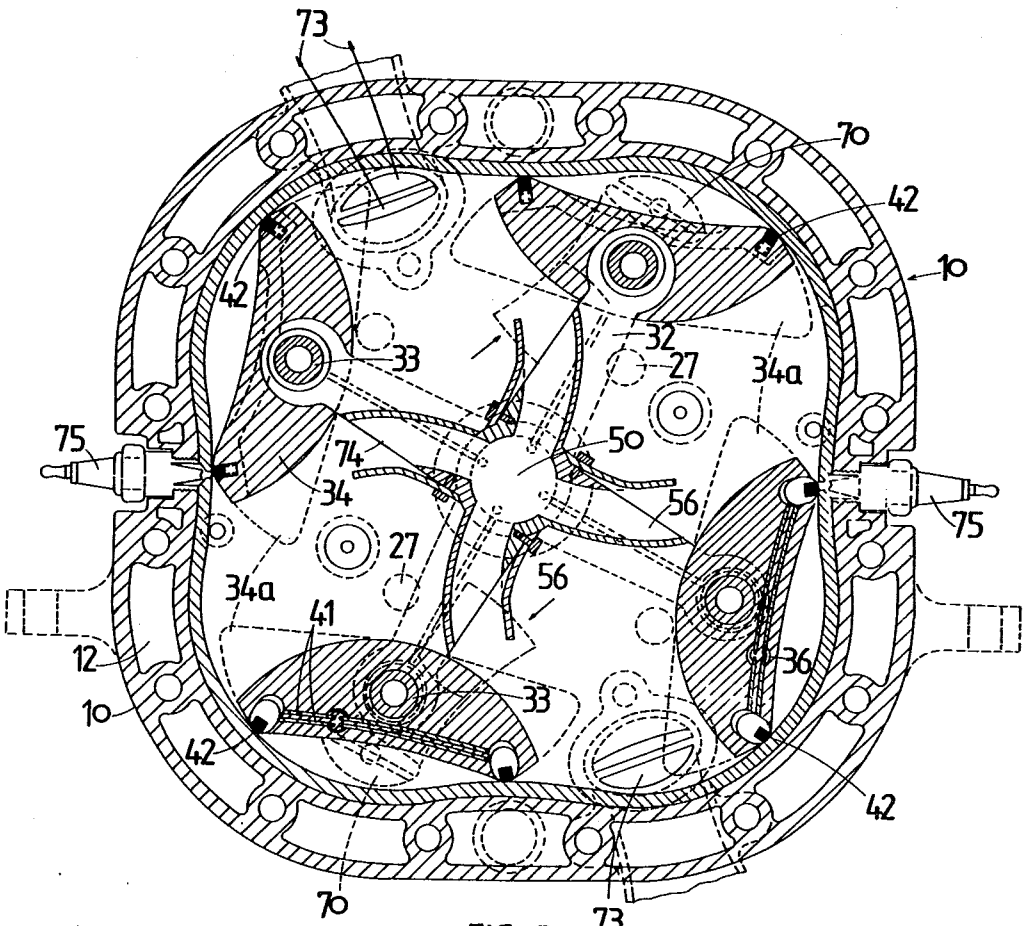
FIG. 3 is a sectioned elevation view of a second form of the invention.
Figure 4:
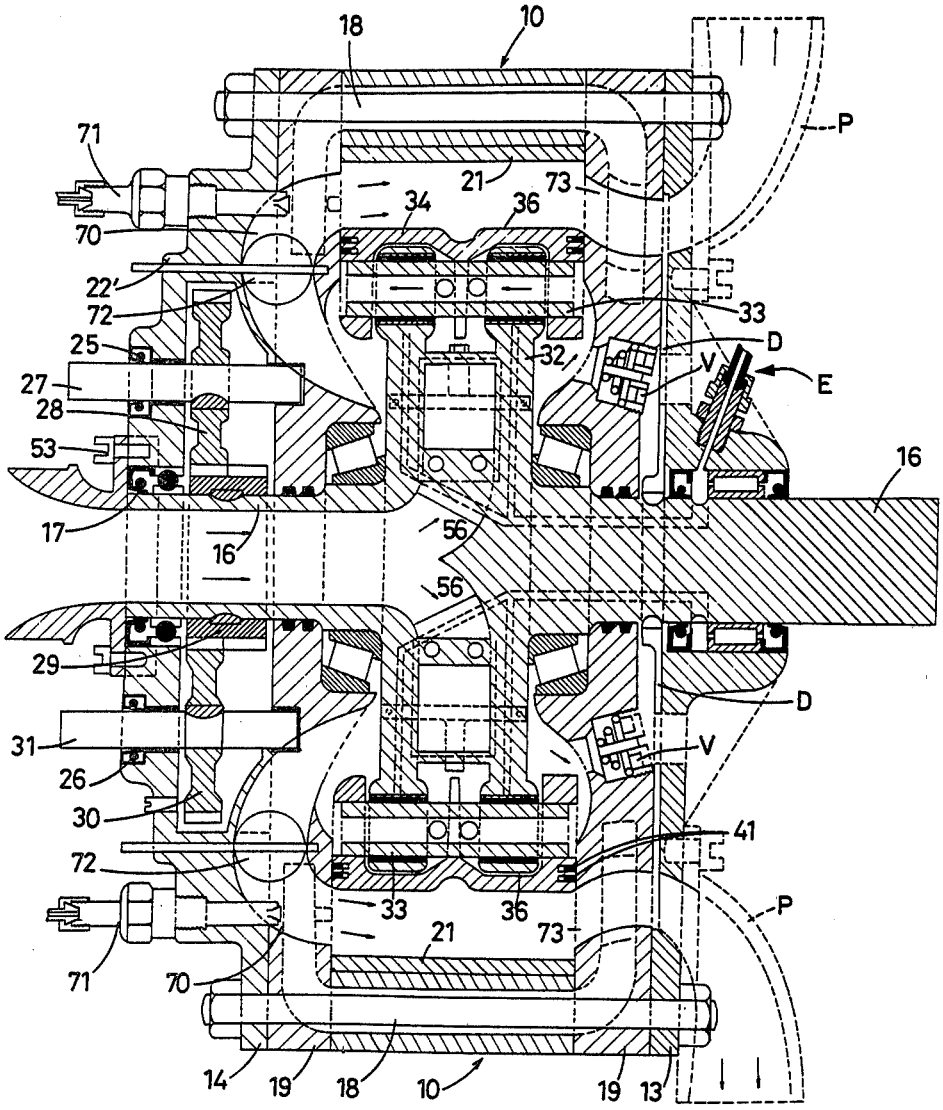
FIG. 4 is a sectioned side view of the engine shown in FIG. 3.

Referring to FIGS. 3 and 4 a similar form of engine is disclosed but one which is automatically supercharged and designed for fuel injection. Like elements of this engine retain the reference numerals of the elements of the engine of FIGS. 1 and 2. The fuel, (which can be unleaded petrol, kerosene or 50/50 mix of unleaded petrol and diesel fuel) is injected through injection port 70 from injector 71. A butterfly valve 72 is provided adjacent the outlet end of bypass channel 57 for air control. The exhaust port is shown at 73. Reed valves 74 are provided at the outlet end of passages 56 for supercharging.

At 75 the glow and/or spark plugs are indicated. With an injection arrangement air passes through passages 56 whilst the same passages provide the intake for petrol, L.P.G. or C.N.G. for non injection models. It can thus be appreciated that the engine is of a universal type which can be supercharged. When the engine is supercharged with four rotator members it has 8 power cycles per revolution.

Ports 70 and 73 are spaced apart by a distance which is substantially equal to the distance between the seal bars 42.

Safety valves V are located to provide a release valve arrangement for gases in the event of a high pressure buildup. An oil feed is shown at E for lubrication purposes.

Once again this engine has centrifugal air for internal cooling, and just as in the embodiment of FIGS. 1 and 2 (when insert 51 is removed) a turbo-charger can be used to give a large volume of high speed cooling air when using high power.

The fins 34*a* on rotators 34 and disc D mounted to rotate with shaft 16 provide port control for supercharging. Two ports are formed in disc D and these successively come into alignment with an exhaust port 73 in face plate 19. This disc D forms a rotary valve which is open, i.e. an opening in disc D is aligned with port 73, before the hot blast of the exhaust gas goes out of the port 73, so it is hardly affected by heat. Then just before the trailing end of the rotator fin 34*a* uncovers this port the rotary valve D closes, the intake suction finishes and an internal compression of the fuel mixture can then be made. Accordingly, fuel mixture is induced through four intake ports 70 and are compressed as the rotators move forward, this compressed charge being fed via the two transfer passages to the combustion chambers. The exhaust pipe P leading from exhaust port 73 is cooled by a fan or where the engine is for aeroplane propulsion by the propellor. As with the design shown in FIGS. 1 and 2 shafts 27 and 31 allow for auxilliary drive.

To make this four head fuel injected, supercharged model into an unsupercharged model (with better cooling) the four reeds are taken out, the control disc of the exhaust ports removed and weaker springs put on the safety valves.

Figure 5:
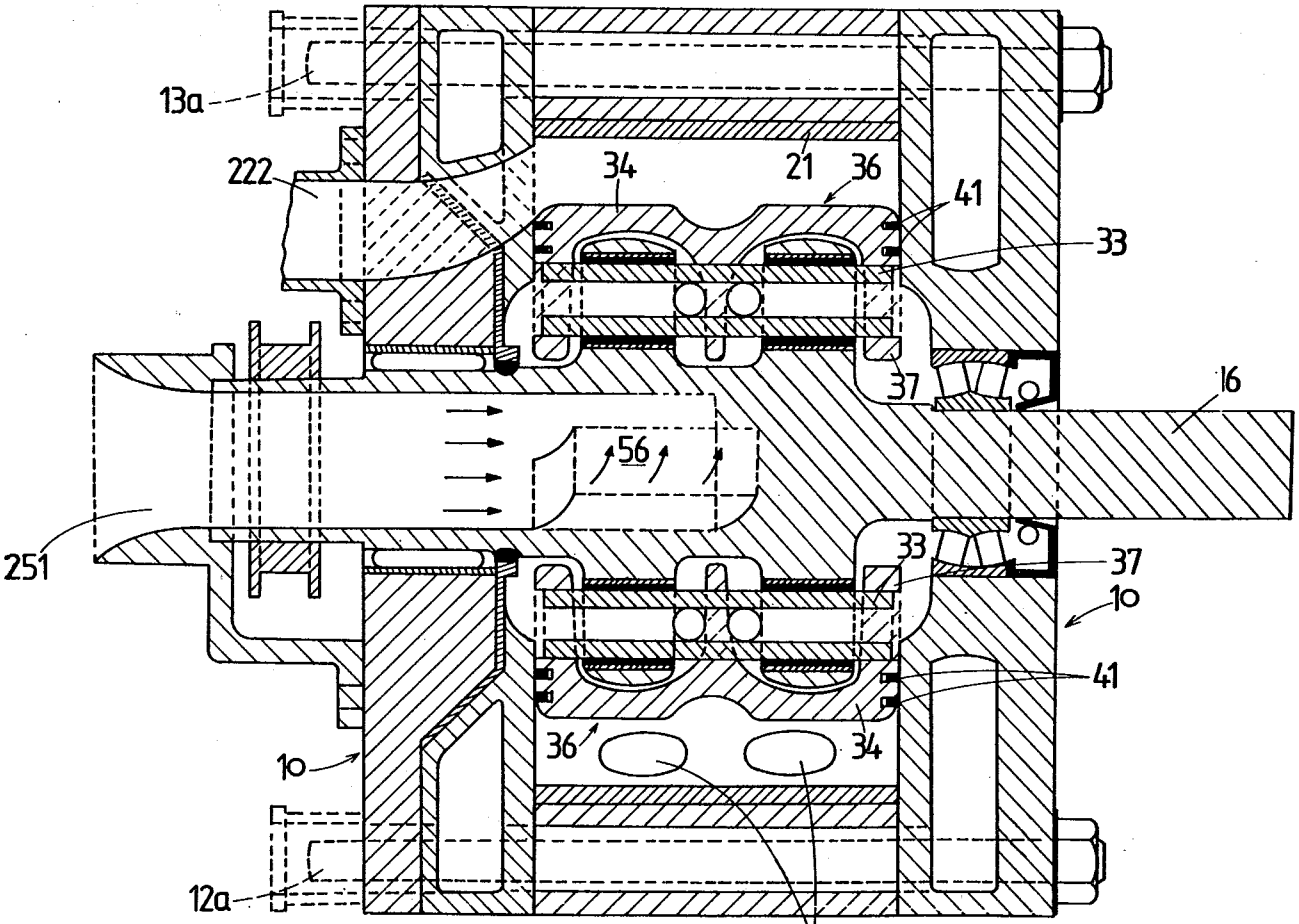
FIG. 5 is a sectioned plan view of a third form of the invention.
Figure 6:
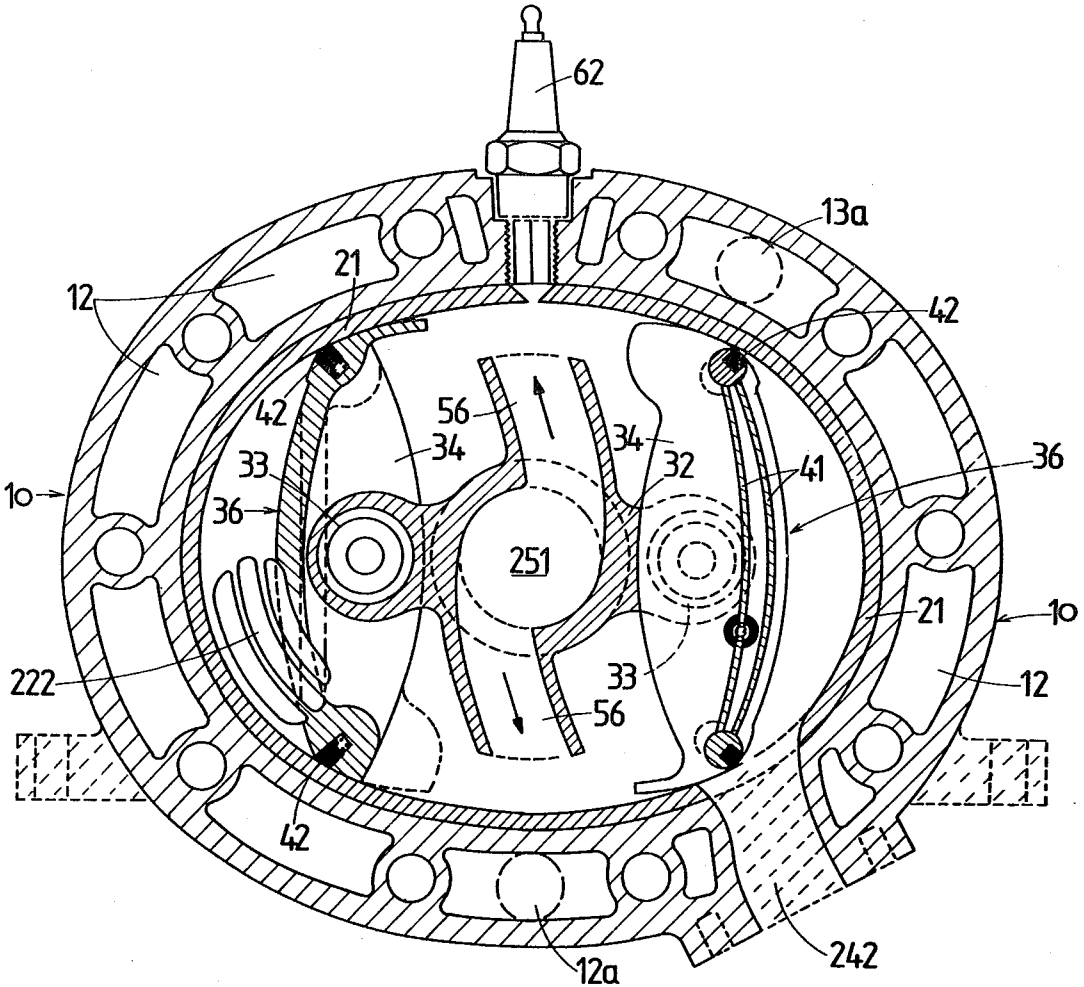
FIG. 6 is a sectioned elevation view of the form shown in FIG. 5.

FIGS. 5 and 6 of the drawings show a configuration of the engine where there is a direct fuel intake system. To avoid repetition of description parts of the engine which correspond to those previously described in FIGS. 1 and 2 bear the same reference numerals.

In this form fuel is inducted directly through intake port 222, and products of combustion exhausted through exhaust ports 242. Cooling air is drawn through air intake 251 to pass through air passages 56 and into the combustion chamber as indicated by the arrows. With diesel models the internal air is directed by a channel to both the front and the rear of an intake chamber. With a petrol model a turbo-charger is used for super air cooling and/or direct chamber charging. This form of the engine is designed to operate continuously on full throttle. There is 360° internal air cooling and thus no hot spots.

Figure 7:
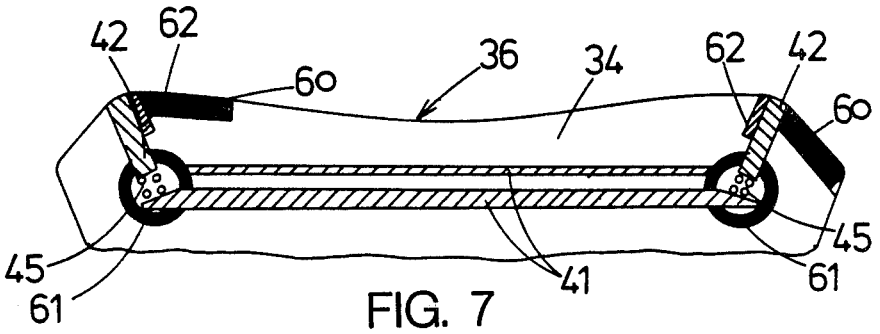
FIG. 7 is an elevation view of a modified form of the rotator.

Referring to FIG. 7, a modified form of the rotator is shown. The rotator control cam 136 is engaged by a cam follower 137*a* which is in the form of a roller bearing supported on control arms 137. This rotator 127 has a pair of seals 131 substantially parallel like the arrangement shown in FIG. 3 with the seals being joined by a coupler 131*a*. The direction of rotation of the rotator is indicated by the arrow appearing in the area of the gudgeon pin 126.

Figure 8:
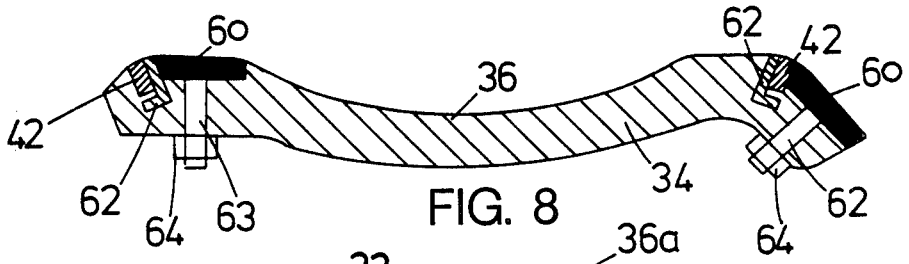
FIG. 8 is a part elevation view of the type of rotator employed with the form of the invention shown in FIGS. 1 and 2.
Figure 9:
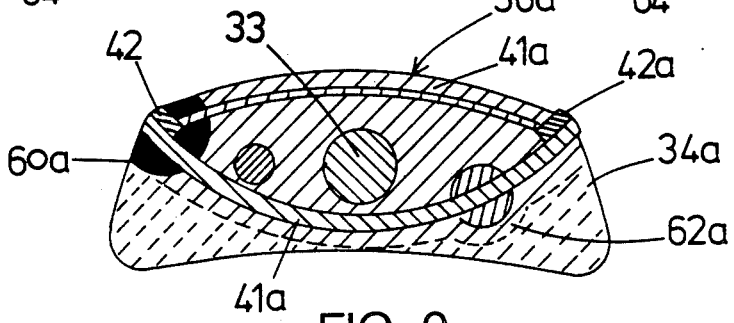
FIG. 9 is a central sectioned elevation view of the rotator shown in FIGS. 1 and 2.

Referring to FIG. 8, there is a part elevation view of the type of the rotator which is employed with the form of the invention shown in FIGS. 1 and 2. The illustration in FIG. 8 corresponds with the upper right hand rotator 34 of FIG. 1 in that it illustrates the rotator in side view. The rotator as shown in FIG. 9 corresponds with the schematic sectioned view of the lower right hand rotator of FIG. 1. In this form of the rotator the side seals 41 are substantially parallel and seal bars 42 are located in grooves 44 extending across the leading and trailing edges of the rotator working face 36. Each seal bar 42 is preceded by an inertial control pad 60 which is located in the working face 36. Each seal bar 42 is spring loaded with springs 45. Springs 45 are located with couplers 61 which couple the side seals 41 and seal bar 42. Each seal bar 42 is associated with a sub-seal 62 which, as can be seen in FIG. 9, is of L shaped cross-section. This seal is also spring loaded by springs (not shown).

This form of rotator has a double line contact sealing by the addition of the L shape sub-seal 62. The control pads 60 work in conjunction with the control flanges 38 (see FIG. 1) as the pads 60 commence the rotator pivot movement and the arms 38 steady the rotator at the end of the desired pivot movement. As can be seen in FIG. 9 the control pads are mounted by studs 63 passing through the body of rotator 34 and are located by nuts 64 threaded onto studs 63 engaging with the surface of the rotator 34 opposite to the working surface 36.

Finally FIG. 10 shows yet a further form of the rotator. In this form rotator 34*a* the side seals 41*a* pass either side of the opening for gudgeon pin 33 with the larger of the two seals being coupled by a coupler 62*a*. The bar seals 42*a* are positioned as shown and the larger of the two side seals 41*a* engage alongside bar seal 42. This form of rotator 34*a* has a spheroidal graphite nodular-iron control pad 60*a*. The weight provided by this control pad 60*a* at the trailing end of the rotator 34*a* keeps the trailing bar seal 42 in smooth contact with the inner curvature of the housing insert 21 by centrifugal force.

The engine according to the present invention meets and accomplishes all the requirements for an efficient rotary internal combustion engine which are:

1. SUPERIOR COOLING. Every surface internally (including the Plug-points), that are subject to heat, have at a minimum; 50% of the time, between power-cycles, for direct cooling plus the normal air or water external cooling.

2. SEALING-GRID. The main seals have no gaps, and each seal is pressurized to the next one.

3. CIRCULAR PATH. Each power producing unit travels in a true circle (not planetary or reciprocating).

4. AUTOMATIC SUPERCHARGING. Double-capacity fuel-charge suction intake; that is pressurized to give about 7 lbs supercharging, plus a powerful turbulence so that there is good mixing of fuel and air.

5. ECONOMY. It has through high compression and diesel fuel injection also a thinner mixture when using petrol is made possible because of supercharging. Also there is a minimum of inertia of all moving parts which saves fuel.

6. BALANCE. All moving parts automatically balanced by a similar moving part at 180°. No counter-weight or fly-wheel is necessary.

7. OILING. Simple as in a 2 stroke where the one supply of oil-petrol-mixture, a dry-sump or oil injection method covers all bearings and inner surfaces.

8. MINIMUM PARTS. Has no connecting rods or gears. The Power-heads transmit straight on to the drive shaft arms.

9. STRENGTH. Parts move in a true circle or have a balanced wave motion. No reciprocating (push-pull stress) or cranks. Usual metals used, and the bearings and shafts of ample size to take 1000 lbs. per sq. in. for diesel compressions.

10. SIZE etc. Small space required, and has less than ⅓ the parts, of the present 4 cycle engine, which fires 2 power cycles per revolution.

What is claimed is:

1. A rotary internal combustion engine comprising a stator having an enclosed chamber, said chamber being defined by a pair of opposing side walls and a peripheral wall extending therebetween, a rotor disposed within the chamber and mounted for rotation by a shaft extending between said side walls, said rotor including at least one arm projecting radially from said shaft and a rotator member pivotally mounted on the end of said arm by a pivot pin, said rotator member having a working surface which spans between said side walls and has leading and trailing surfaces in contact with said peripheral wall thereby defining a combustion chamber, an air inlet for introducing air into said chamber, the pivot pin being hollow, and air ducting means communicating between the interior of the chamber outside the rotator member, and the hollow interior of the pivot pin, to permit air supplied to said chamber from said inlet to be ducted to the hollow interior of the pivot pin.

2. The engine according to claim 1, said air ducting means being disposed in the stator.

3. The engine according to claim 1 wherein the or each arm has a bifurcated free end with the pivot pin journalled in bearings carried in openings in said bifurcated portion, said air ducting means being at least one passageway in said pivot pin which passageway extends from the interior of the pivot pin to the exterior at a point located between the finger portions forming the bifurcated portion of said arm.

4. The engine according to claim 1 wherein said air introducing means comprises a bore extending along said shaft from one end thereof, at least one passageway extending transversely from said bore to have an outlet end opening into said chamber.

5. The engine according to claim 4 wherein the or each transverse passageway is formed to at least partially extend through a said arm with the outlet end thereof being located in said arm.

6. The engine according to claim 4 wherein the stator includes transfer means for transferring air introduced into said chamber by said air introducing means to said combustion chamber.

7. The engine according to claim 6 wherein said transfer means is a recess in one or both said side walls, said recess being of a length which as said rotator passes thereover provides communication between the chamber and combustion chamber.

8. The engine according to claim 6 wherein said transfer means is a passageway in one or both side walls opening at each end into said chamber and of such length that as said rotator passes thereover provides communication between the chamber and combustion chamber.

9. The engine according to claim 8 wherein fuel injection means and an air control valve means are incorporated within said passageway of the transfer means.

10. The engine according to claim 6 wherein closure means are provided to close said arm passageway from the bore in said shaft during communication between the chamber and combustion chamber by said transfer means.

11. The engine according to claim 1 wherein said rotator members have side skirts extending from said working surface toward the shaft, said skirts slidingly engaging with said side walls, the leading and trailing portions of said working surface each having a transversely disposed elongate sealing member which extends between said side walls.

12. The engine according to claim 11 wherein said elongate sealing members are located in recesses in said rotator member and are spring biassed to retain contact with said peripheral wall, the side skirts having at least one seal spanning between the pair of elongate sealing members.

13. The engine according to claim 12 wherein a control pad is located on said working surface immediately preceding each of said elongate sealing members, said control pads being in sliding contact with said peripheral surface of the stator and forming a point of contact between said leading and trailing surfaces to thereby impart pivot movement to said rotator member as said shaft rotates.

14. The engine according to claim 13 wherein the or each rotator member has at least one control member engaged in sliding contact with a fixed control surface carried by said stator to limit pivot movement of said rotator member and thereby ensure the leading and trailing edges remain in constant sliding contact with the peripheral surface.

15. The engine according to claim 14 wherein the or each control arm extends from a side skirt of said rotator member to engage with said control surface which is fixedly carried by one side wall of the stator.

16. The engine according to claim 11 wherein a pair of seals are provided in each side skirt of said rotator member, said pair of seals being parallel to one another and coupled at their ends to said transverse seals.

17. The engine according to claim 16 wherein at least one of said seals follows the general contour of the working surface of the rotator member.

18. The engine according to claim 16 wherein said seals are coupled to said transverse seals by spring biassed coupling means.

19. The engine according to claim 11 wherein inlet and outlet ports are provided in the side walls of said chamber, said skirts of said rotator members having extensions thereof which during rotation of said rotor successively cover and uncover said exhaust ports, there being further included disc valve means rotatable with said shaft and covering said outlet ports, said disc valve means having openings which align with said exhaust ports prior to the exhaust ports being opened to said chamber by said skirt extensions passing thereover.

20. The engine according to claim 1 wherein the radially disposed outlets of the air introducing means face away from the direction in which the rotor moves.

* * * * *